US011028615B1

(12) United States Patent
Rocha, Jr.

(10) Patent No.: US 11,028,615 B1
(45) Date of Patent: Jun. 8, 2021

(54) DOUBLE-SIDED GATE HANDLE

(71) Applicant: John P Rocha, Jr., Freehold, NJ (US)

(72) Inventor: John P Rocha, Jr., Freehold, NJ (US)

( * ) Notice: Subject to any disclaimer, the term of this patent is extended or adjusted under 35 U.S.C. 154(b) by 0 days.

(21) Appl. No.: 17/117,525

(22) Filed: Dec. 10, 2020

(51) Int. Cl.
*E05B 1/00* (2006.01)
*E05B 1/06* (2006.01)

(52) U.S. Cl.
CPC ..... *E05B 1/0015* (2013.01); *E05B 1/06* (2013.01)

(58) Field of Classification Search
CPC ..... E05B 1/0015; E05B 1/0061; E05B 1/06; E05F 5/02; E05F 5/027
USPC ..... 16/412, 414, 415; 292/352, 340, 288; 256/73
See application file for complete search history.

(56) References Cited

U.S. PATENT DOCUMENTS 2,904,368 A * 9/1959 Taubman ..... E05B 1/0015 292/347
3,410,026 A * 11/1968 Casebolt ..... E06B 3/02 49/397
3,514,904 A * 6/1970 Riegelman ..... E05B 1/0015 49/460
3,676,895 A * 7/1972 Stewart ..... E05B 1/0015 16/412
3,764,173 A * 10/1973 Griffith ..... E05B 17/2084 292/346
4,021,880 A * 5/1977 Murphy ..... E05F 5/02 16/82
4,178,027 A * 12/1979 Charron ..... E05B 17/2003 292/346
4,345,787 A * 8/1982 Dabrowski ..... E05B 17/2003 292/346
4,489,968 A * 12/1984 Easley ..... E05B 65/06 16/86 A
4,805,263 A * 2/1989 Kurtz ..... E05B 1/0015 16/443
4,817,239 A * 4/1989 Campbell ..... E05B 1/0053 16/413
5,379,821 A * 1/1995 Pergolizzi ..... E05B 1/0015 160/371
5,732,442 A * 3/1998 Haggard ..... B60N 3/02 16/110.1

(Continued)

FOREIGN PATENT DOCUMENTS

CN 203160834 U 8/2013
CN 203188686 U 9/2013

(Continued)

*Primary Examiner* — Jeffrey O'Brien
(74) *Attorney, Agent, or Firm* — David Postolski, Esq.; Gearhart Law LLC

(57) ABSTRACT

A double-sided gate handle device is described. The device includes a first portion having a first handle and a second portion having a second handle and a stopper component. The first portion is separated by a distance from the second portion and the first portion is parallel to the second portion. At least one adjustable component is disposed between the first portion and the second portion by the distance and is perpendicular to the first portion and the second portion. A gate is received within the distance. The at least one adjustable component allows the device to be adjusted to fit gates of varying widths. The stopper component comprises a body component and a first side disposed opposite a second side. The second side of the stopper component is configured to contact a gatepost.

6 Claims, 8 Drawing Sheets

(56) References Cited

U.S. PATENT DOCUMENTS

| | | | | |
|---|---|---|---|---|
| D407,293 | S * | 3/1999 | Haggard | D12/106 |
| 6,382,750 | B1 * | 5/2002 | King | A47B 95/00 16/901 |
| 6,739,093 | B1 | 5/2004 | Holbert | |
| 6,857,672 | B1 * | 2/2005 | Drew, II | E05B 15/0205 292/340 |
| 7,043,799 | B2 * | 5/2006 | Moody | E05B 53/001 16/412 |
| 7,147,213 | B1 * | 12/2006 | Amendola | E06B 11/02 256/73 |
| 7,219,394 | B2 * | 5/2007 | Wu | E05B 1/0015 16/412 |
| 7,373,694 | B1 * | 5/2008 | Kopp | E05B 1/0015 16/412 |
| 7,383,654 | B2 * | 6/2008 | Olivier | E05B 1/0015 40/331 |
| 8,365,360 | B2 * | 2/2013 | Kunnath | A47B 95/02 16/415 |
| 8,646,815 | B2 * | 2/2014 | Timothy | E05C 3/30 292/69 |
| 9,022,359 | B2 | 5/2015 | McAlmond | |
| 9,347,240 | B2 * | 5/2016 | Herman | E05B 1/0015 |
| 9,500,315 | B2 * | 11/2016 | Ajello | E05C 19/02 |
| 10,156,085 | B2 * | 12/2018 | Standley | E05B 1/003 |
| 10,316,577 | B2 * | 6/2019 | Fontijn | E06B 3/46 |
| 10,349,784 | B2 * | 7/2019 | Lieb | E05C 19/16 |
| 10,494,834 | B2 * | 12/2019 | Schrader | E05B 1/0015 |
| 10,718,134 | B1 * | 7/2020 | Dory | E05B 53/003 |
| 10,844,627 | B2 * | 11/2020 | Herman | E05B 1/0053 |
| 2002/0020038 | A1 * | 2/2002 | Wilkes | E05B 3/06 16/412 |
| 2009/0139050 | A1 * | 6/2009 | Junkins | E05C 17/54 16/84 |
| 2018/0119473 | A1 * | 5/2018 | Jensen | E05F 5/06 |

FOREIGN PATENT DOCUMENTS

| | | | |
|---|---|---|---|
| CN | 204531624 | U | 8/2015 |
| CN | 204531625 | U | 8/2015 |
| CN | 204531628 | U | 8/2015 |
| CN | 206928762 | U | 1/2018 |

* cited by examiner

100

DOUBLE-SIDED GATE HANDLE

FIELD OF THE EMBODIMENTS

The field of the invention and its embodiments relate to a double-sided gate handle. In particular, the field of the invention and its embodiments relate to a double-sided gate handle having a stopper component.

BACKGROUND OF THE EMBODIMENTS

A gate is a hinged barrier used to close an opening in a wall, fence, or hedge. Gates typically have a single handle. If a handle is needed on both sides of the gate, two handles must be installed, which may result in damage to the gate. Another device that may be installed onto a gate is a gatestop. A gatestop serves to stop the gate in the closed position, so that a gate latch can fall into place. Gatestops protect latches and hinges when gates are closed hard or slammed. However, no device exists which incorporates two gate handles and a gatestop.

Review of related technology:

CN 206928762 U describes a two-sided handle. The two-sided handle includes a main handle part A, a clamp plate, and a main handle part B.

CN 204531628 U describes a two-sided handle. The two-sided handle includes two handles, a handle seat, a square shaft, two square shaft covers, two covers, two screws, two face lids, and a spring.

CN 204531624 U describes a two-sided handle. The two sided handle includes a handle seat, a square shaft, two square shaft covers, two face lids, two screws, and a spring card.

CN 204531625 U describes a two-sided handle. The two-sided handle includes an interior handle seat, an outer handle seat, two handles, two square shaft covers, a square shaft, eight location springs, four sliders, two setting elements, a plurality of screws, and a handle flap.

CN 203188686 U describes a double-sided lever handle for doors and windows. The double-sided lever handle comprises lever handle devices placed on two sides of the door or window, where the two lever handle devices are connected through a square cotter penetrating through the door or window. The double-sided lever handle is characterized in that each lever handle device comprises a lever handle, a lever handle base, a gear sleeve, a bottom plate arranged inside the lever handle base, sliding blocks arranged at the upper end and the lower end of the bottom plate, compressed springs arranged in the sliding blocks, and a lever handle base gasket arranged on the front side of an installation hole of the lever handle base. The gear sleeve penetrates through the bottom plate, the lever handle base and the lever handle base gasket so as to be assembled into a whole with the lever handle. A cross countersunk screw used for fixing each lever handle device is arranged in the gear sleeve.

CN 203160834 U describes a two-sided handle for doors. The two-sided handle includes an outer handle body and an inner handle body, which are connectively arranged on two sides of a door through a square cotter, such that the distance between the outer handle body and the inner handle body is 60 millimeters.

U.S. Pat. No. 6,739,093 B1 describes a farm gatestop device suitable for use on both level and unlevel terrain.

U.S. Pat. No. 9,022,359 B2 describes a gatestop.

Various gate handles are known in the art. However, their means of operation are substantially different from the present disclosure, as the other inventions fail to solve all the problems taught by the present disclosure.

SUMMARY OF THE EMBODIMENTS

The present invention and its embodiments relate to a double-sided gate handle. In particular, the present invention and its embodiments relate to a double-sided gate handle having a stopper component.

A first embodiment of the present invention describes a double-sided gate handle. The double-sided gate handle comprises a first portion, a second portion, and at least one adjustable component, such that the double-sided gate handle comprises a U-shaped configuration. The first portion of the double-sided gate handle includes a body component and a first side disposed opposite a second side. The first side of the first portion comprises a first handle component.

The second portion of the double-sided gate handle includes a body component and a first side disposed opposite a second side. The body component of the second portion includes a stopper component. The stopper component includes a body component and a first side disposed opposite a second side. The second side of the stopper component is configured to contact a gatepost. A gatepost is the vertical post on which a gate is suspended by hinges, or the post against which the gate is close. Further, the first side of the second portion comprises a second handle component.

The second side of the first portion is separated by a distance from the second side of the second portion. Further, the second side of the first portion is parallel to the second side of the second portion. Moreover, in the first embodiment, at least one adjustable component is disposed between the second side of the first portion and the second side of the second portion by the distance. The at least one adjustable component is perpendicular to the second side of the first portion and the second side of the second portion.

A gate is configured to be received within the distance such that the second side of the first portion contacts a first portion of the gate, the second side of the second portion contacts a second portion of the gate, and the at least one adjustable component contacts at least a third portion of the gate.

In some examples of the first embodiment, the at least one adjustable component comprises a first adjustable component and a second adjustable component. However, it should be appreciated that a quantity of the adjustable components is not limited to two. The first adjustable component comprises: a first protrusion extending from a first location on the second side of the first portion and a second protrusion extending from a first location on the second side of the second portion. The second adjustable component comprises a third protrusion extending from a second location on the second side of the first portion and a fourth protrusion extending from a second location on the second side of the second portion. The first protrusion and the third protrusion comprises a planar shape. The second protrusion and the fourth protrusion comprises a planar shape having an opening disposed therein.

A width of the opening of each of the second protrusion and the fourth protrusion is larger than a width of the first protrusion and the third protrusion. When adjusting the at least one adjustable component, the opening of the second protrusion is configured to slidably receive the first protrusion therein and the opening of the fourth protrusion is configured to slidably receive the third protrusion therein.

A second embodiment of the present invention describes a double-sided gate handle. The double-sided gate handle includes a first portion, a second portion, and a third portion, such that the double-sided gate handle comprises a U-shaped configuration. The first portion of the second embodiment of the double-sided gate handle includes a body component and a first side disposed opposite a second side. The first side of the first portion includes a first handle component. The second portion includes a body component and a first side disposed opposite a second side. The body component of the second portion includes a stopper component. The stopper component includes a body component and a first side disposed opposite a second side. The second side of the stopper component is configured to contact a gatepost.

The first side of the second portion includes a second handle component. The first handle comprises a first size and the second handle comprises a second size. In a first example, the first size of the first handle differs from the second size of the second handle. In a second example, the first size of the first handle is identical to the second size of the second handle. Additionally, the first handle comprises a first shape and the second handle comprises a second shape. In another example, the first shape of the first handle differs from the second shape of the second handle. In an additional example, the first shape of the first handle is identical to the second shape of the second handle.

The second side of the first portion is separated by a distance from the second side of the second portion. Further, the second side of the first portion is configured parallel to the second side of the second portion. The third portion includes a body component and a first side disposed opposite a second side. The third portion is disposed between the second side of the first portion and the second side of the second portion by the distance. Further, the third portion is perpendicular to the second side of the first portion and the second side of the second portion.

It should be appreciated that the gate is configured to be received within the distance such that the second side of the first portion contacts a first portion of the gate, the second side of the second portion contacts a second portion of the gate, and the second side of the third portion contacts a third portion of the gate. Moreover, the double-sided gate handle is installed on the gate by one or more fixation means.

In general, the present invention succeeds in conferring the following benefits and objectives.

The present invention provides a double-sided gate handle device. The present invention provides a double-sided gate handle device comprising a stopper component.

DESCRIPTION OF THE PREFERRED EMBODIMENTS

Figure 1:
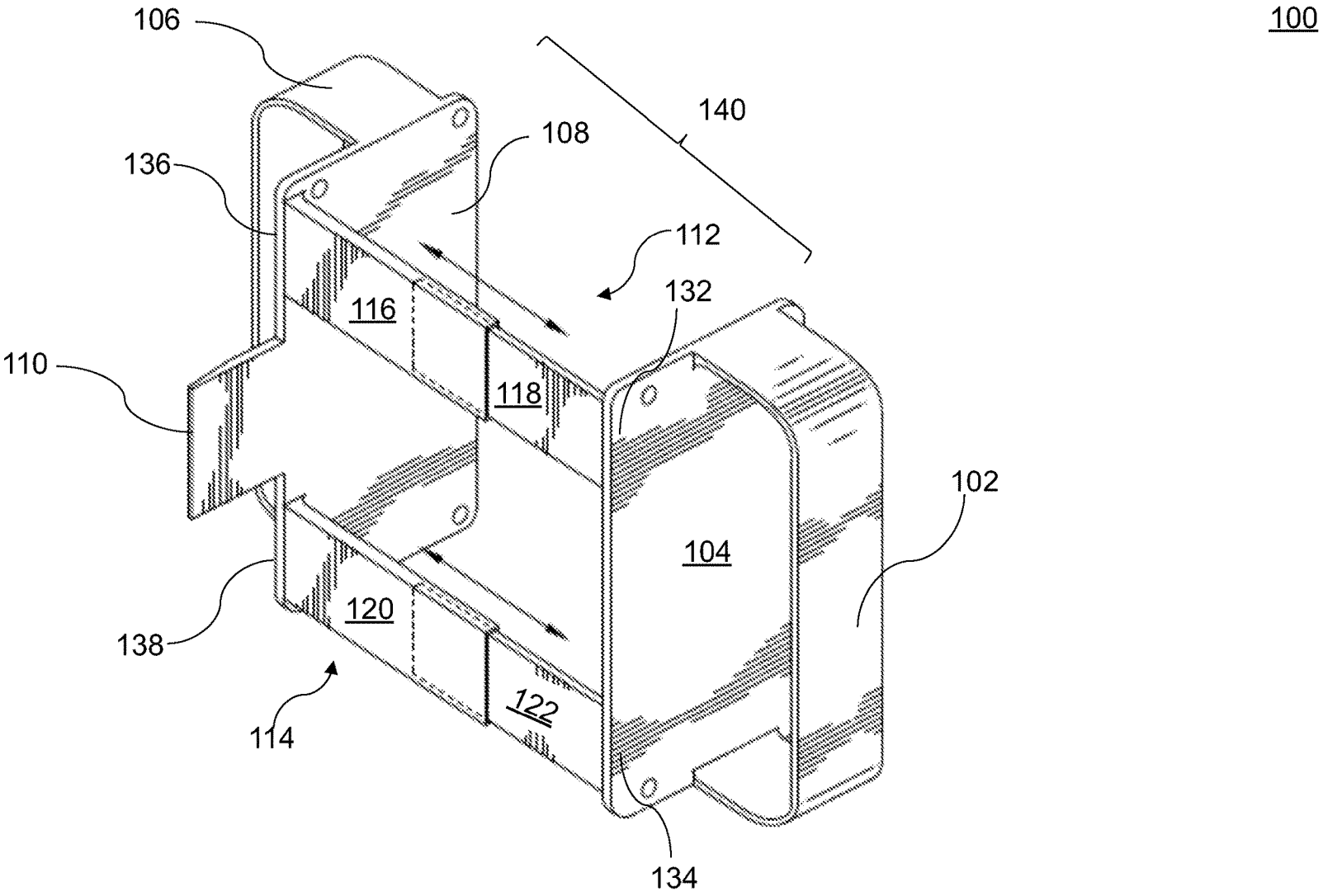
FIG. 1 depicts a perspective view of a first embodiment of a double-sided gate handle device, according to at least some embodiments disclosed herein.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

As explained supra, gate is a hinged barrier used to close an opening in a wall, fence, or hedge. Another device that may be installed onto a gate is a gatestop. The gatestop serves to stop the gate in the closed position, so that a gate latch can fall into place. Gatestops protect latches and hinges when gates are closed hard or slammed. Gatestops prevent hinge, latch, and gate damage to prolong the lifetime of a gate. A double-sided gate handle is described and depicted herein that includes a first handle component, a second handle component, and a gatestopper component.

Figure 2:
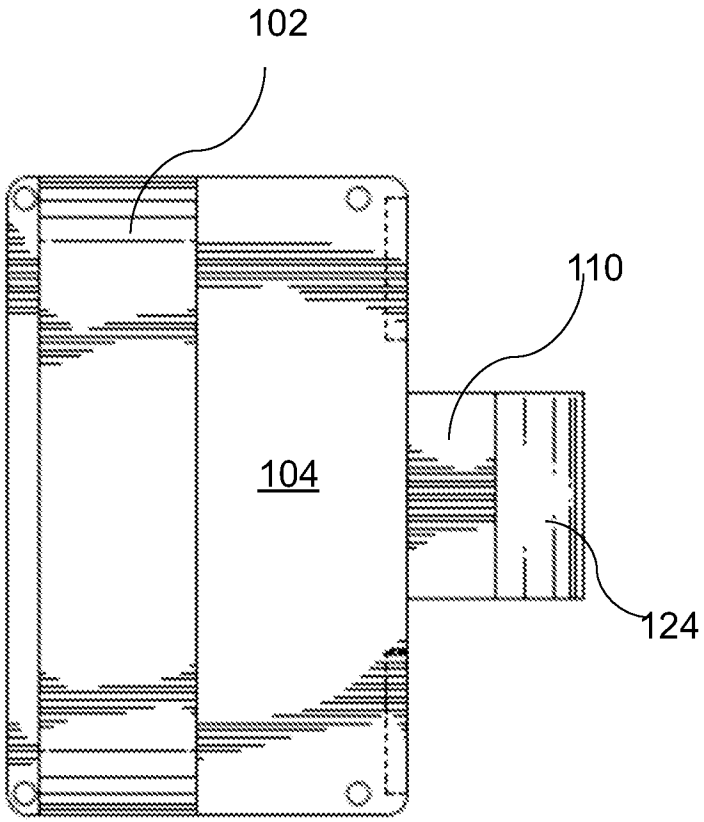
FIG. 2 depicts a left view of a first embodiment of a double-sided gate handle device having a stopper component, according to at least some embodiments disclosed herein.
Figure 3:
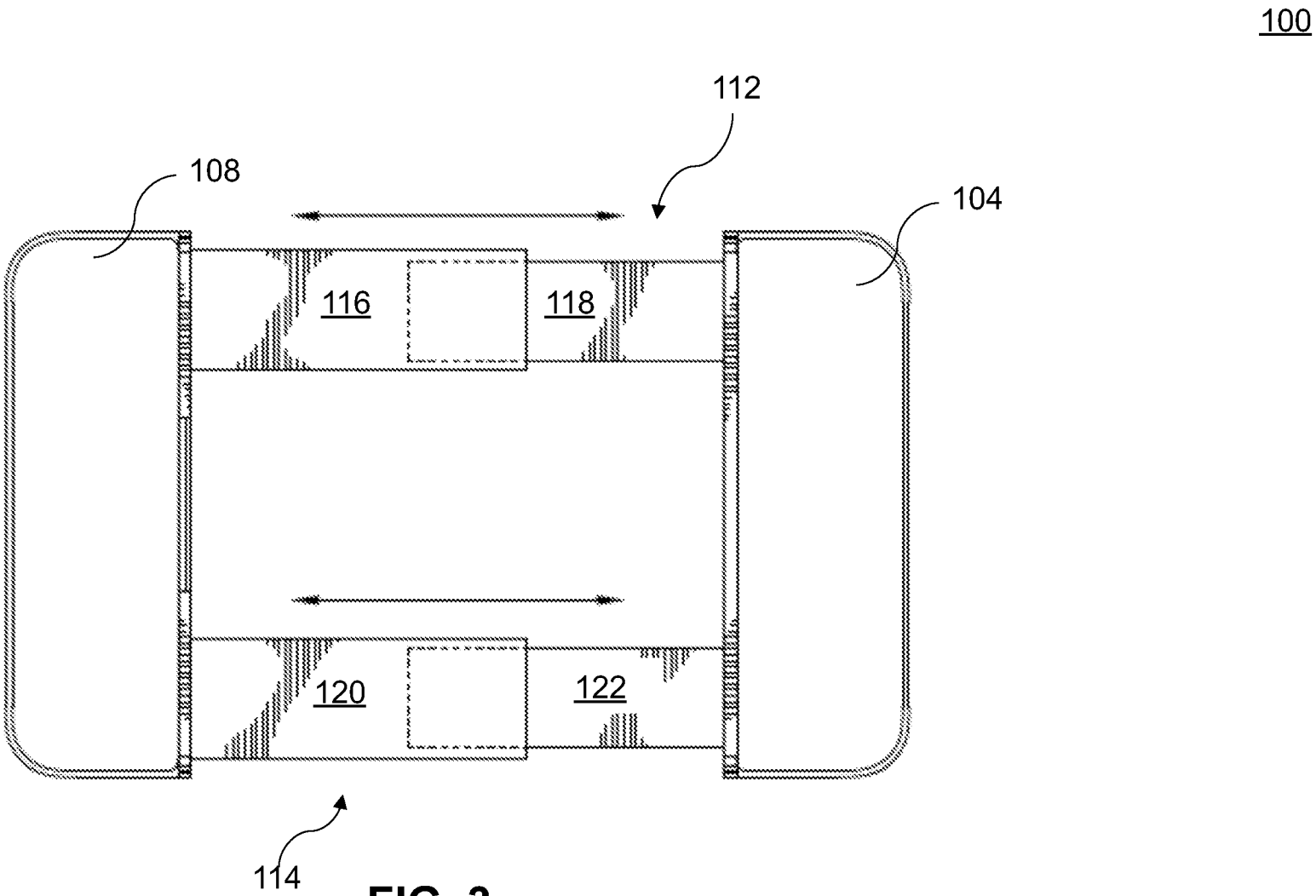
FIG. 3 depicts a side view of a first embodiment of a double-sided gate handle device, according to at least some embodiments disclosed herein.
Figure 4:
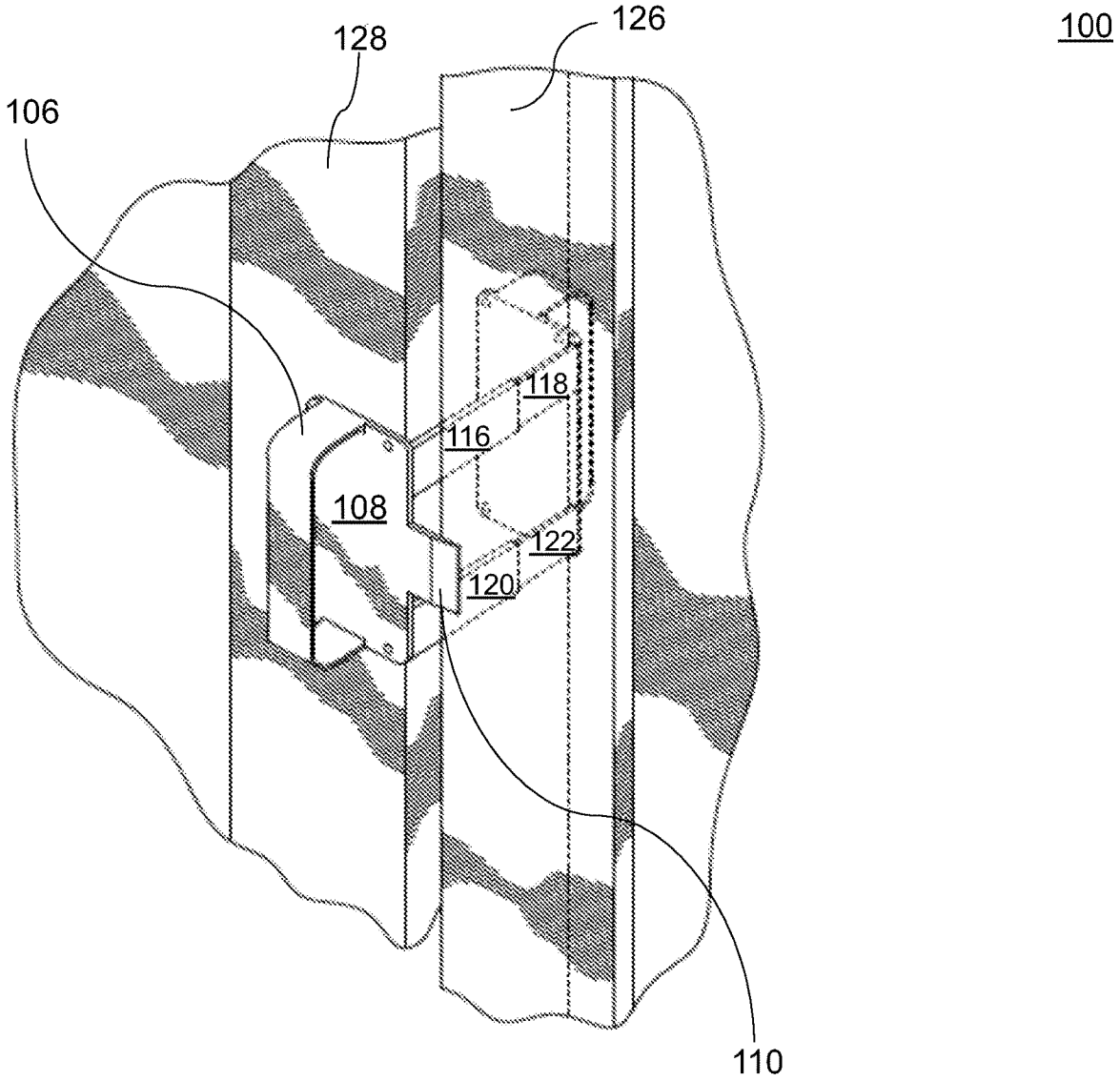
FIG. 4 depicts a perspective of a first embodiment of a double-sided gate handle device affixed to a gate, according to at least some embodiments disclosed herein.

In a first embodiment, as depicted in FIG. 1, FIG. 2, FIG. 3, and FIG. 4, a double-sided gate handle device 100 comprises a first portion 104, a second portion 108, and at least one adjustable component, such that the double-sided gate handle device 100 comprises a U-shaped configuration. The first portion 104 of the double-sided gate handle device 100 includes a body component and a first side disposed opposite a second side. The first side of the first portion 104 comprises a first handle component 102.

The second portion 108 of the double-sided gate handle device 100 includes a body component and a first side disposed opposite a second side. The body component of the second portion 108 includes a stopper component 110 (e.g., a gatestopper component). The stopper component 110 includes a body component and a first side disposed opposite a second side. The second side of the stopper component 110 is configured to contact a gatepost 126 (of FIG. 4). In some examples, the second side of the stopper component 110 may comprise a bumper component 124 (of FIG. 2) that contacts the gatepost 126. The bumper component 124 may comprise a material to prevent damage to the gatepost 126 when the stopper component 110 engages the gatepost 126. Such material may include a polymer material and/or a rubber material. It should be appreciated that the material of the bumper component 124 may be any material and the material is not limited to those explicitly described herein.

Further, the first side of the second portion 108 of the double-sided gate handle device 100 comprises a second handle component 106. The first handle component 102 comprises a first size and the second handle component 106 comprises a second size. In a first example, the first size of the first handle component 102 differs from the second size of the second handle component 106. In a second example, the first size of the first handle component 102 is identical to the second size of the second handle component 106. Additionally, the first handle component 102 comprises a first shape and the second handle component 106 comprises a second shape. In another example, the first shape of the first handle component 102 differs from the second shape of the second handle component 106. In an additional example, the first shape of the first handle component 102 is identical to the second shape of the second handle component 106.

The second side of the first portion 104 is separated by a distance 140 (of FIG. 1) from the second side of the second portion 108. Further, the second side of the first portion 104 is parallel to the second side of the second portion 108. Moreover, in the first embodiment, at least one adjustable component (e.g., a first adjustable component 112 and a second adjustable component 114) is disposed between the second side of the first portion 104 and the second side of the second portion 108 by the distance 140. The at least one adjustable component (e.g., the first adjustable component 112 and the second adjustable component 114) is perpendicular to the second side of the first portion 104 and the second side of the second portion 108. However, it should be appreciated that a quantity of the at least one adjustable component is not limited to two.

The at least one adjustable component (e.g., the first adjustable component 112 and the second adjustable component 114) allows the double-sided gate handle device 100 to be adjustable (e.g., expandable and collapsible) to fit onto different sized gates. Such adjustability is depicted by double-sided arrows in FIG. 1. A gate 128 (of FIG. 4) is configured to be received within the distance 140 such that the second side of the first portion 104 contacts a first portion of the gate 128, the second side of the second portion 108 contacts a second portion of the gate 128, and the at least one adjustable component (e.g., the first adjustable component 112 and the second adjustable component 114) contacts at least a third portion of the gate 128. The gate 128 may comprise a wood material, a vinyl material, and/or a metal material, among other materials not explicitly listed herein. Moreover, the double-sided gate handle device 100 may be installed on the gate 128 by one or more fixation means, such as screws, nails, etc.

In some examples of the first embodiment, the first adjustable component 112 comprises: a first protrusion 118 extending from a first location 132 on the second side of the first portion 104 and a second protrusion 116 extending from a first location 136 on the second side of the second portion 108. The second adjustable component 114 comprises a third protrusion 122 extending from a second location 134 on the second side of the first portion 104 and a fourth protrusion 120 extending from a second location 138 on the second side of the second portion 108. The first protrusion 118 and the third protrusion 122 comprises a planar shape. The second protrusion 116 and the fourth protrusion 120 comprises a planar shape having an opening disposed therein.

A width of the opening of each of the second protrusion 116 and the fourth protrusion 120 is larger than a width of the first protrusion 118 and the third protrusion 122. When adjusting the distance 140 of the double-sided gate handle device 100 to accommodate a specific width of a gate, the opening of the second protrusion 116 is configured to slidably receive the first protrusion 118 therein and the opening of the fourth protrusion 120 is configured to slidably receive the third protrusion 122 therein.

Figure 5:
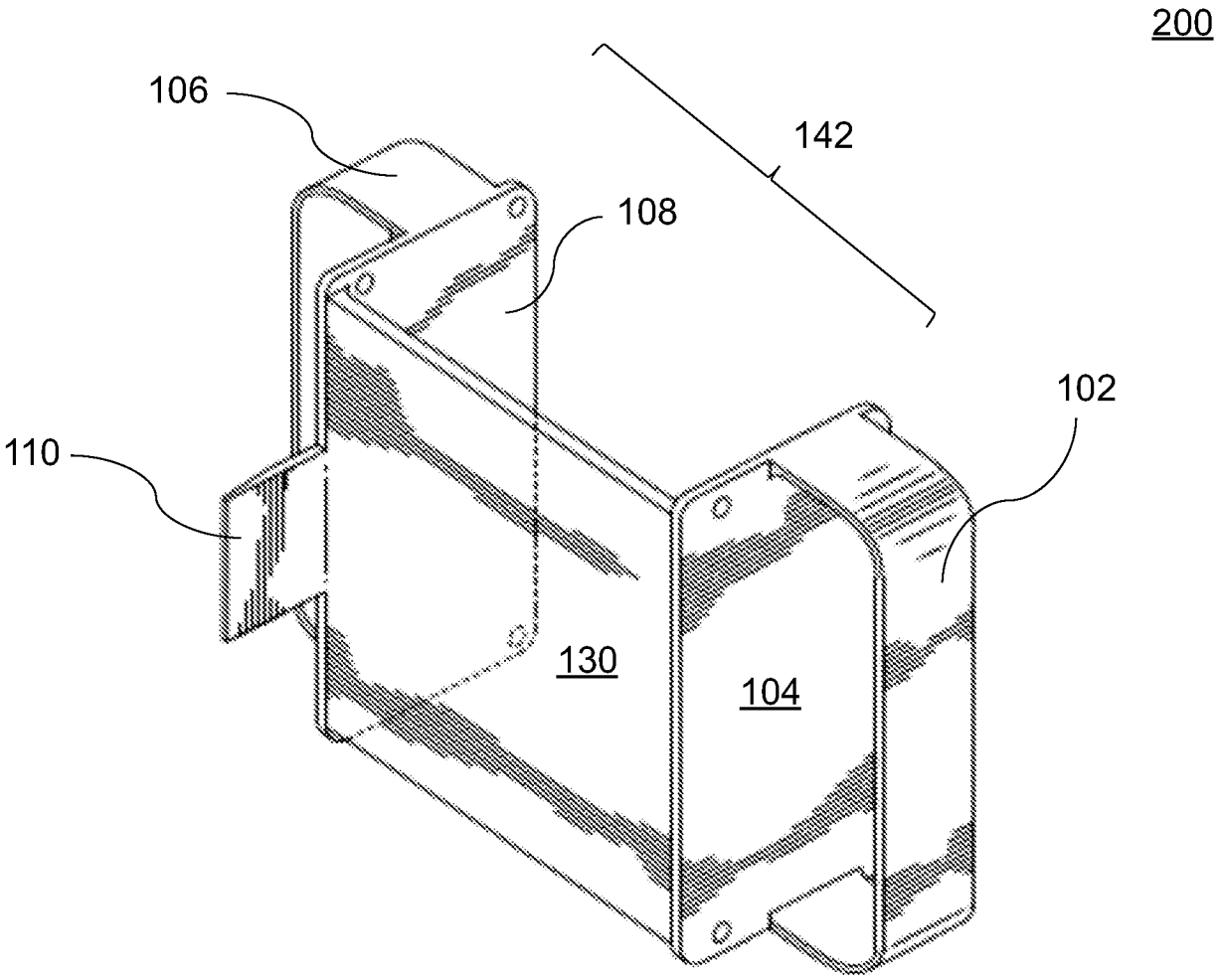
FIG. 5 depicts a perspective view of a second embodiment of a double-sided gate handle device, according to at least some embodiments disclosed herein.
Figure 6:
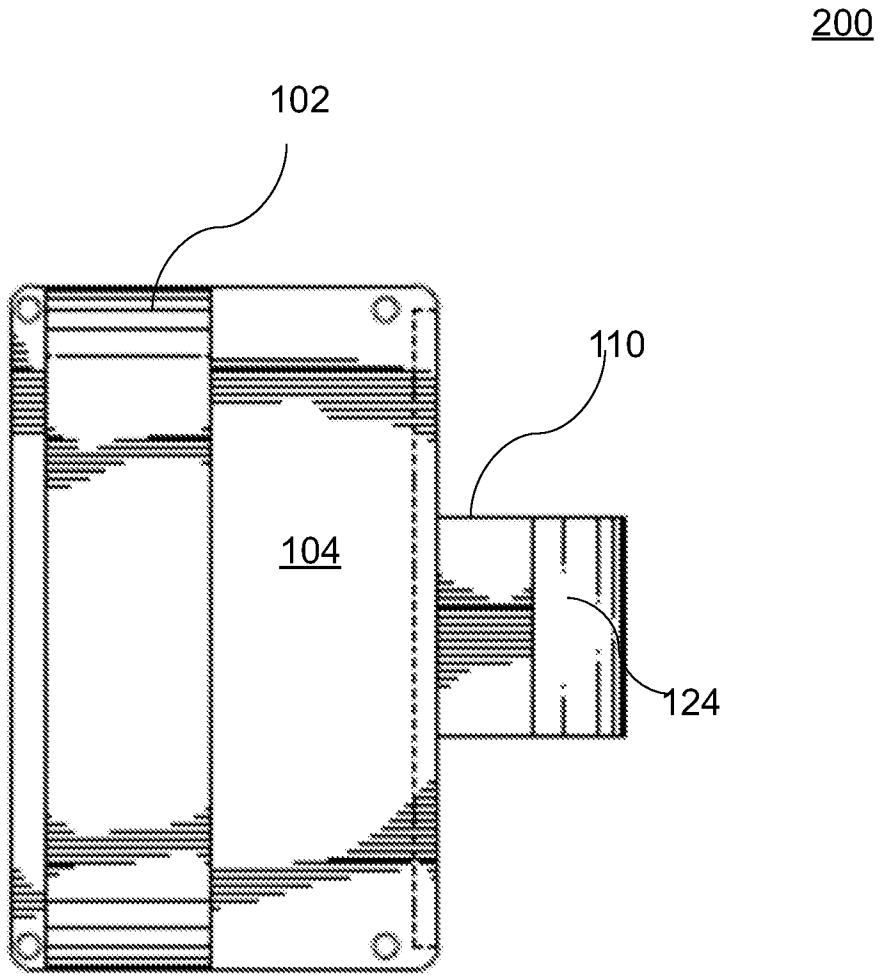
FIG. 6 depicts a left view of a second embodiment of a double-sided gate handle device having a stopper component, according to at least some embodiments disclosed herein.
Figure 7:
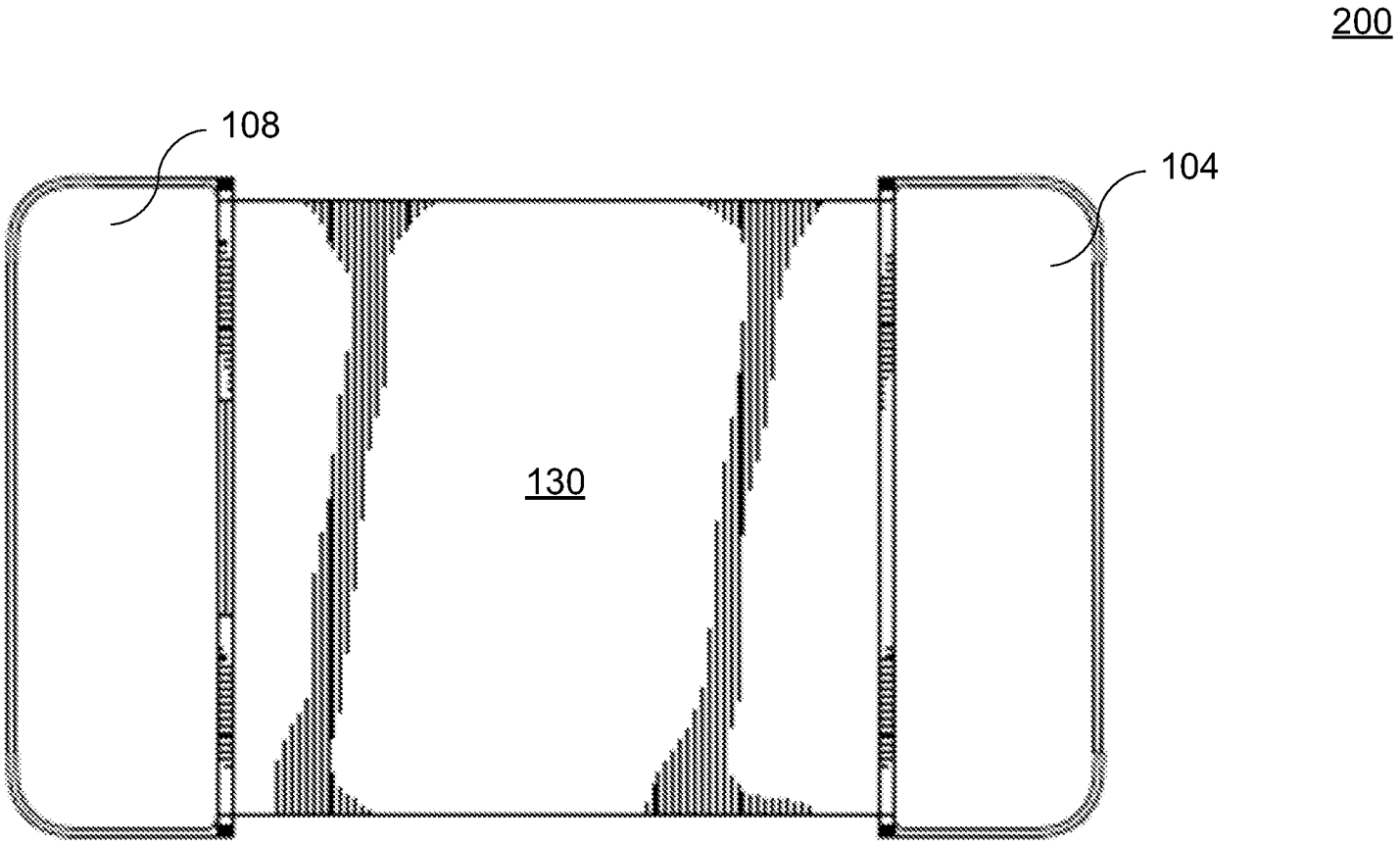
FIG. 7 depicts a side view of a second embodiment of a double-sided gate handle device, according to at least some embodiments disclosed herein.
Figure 8:
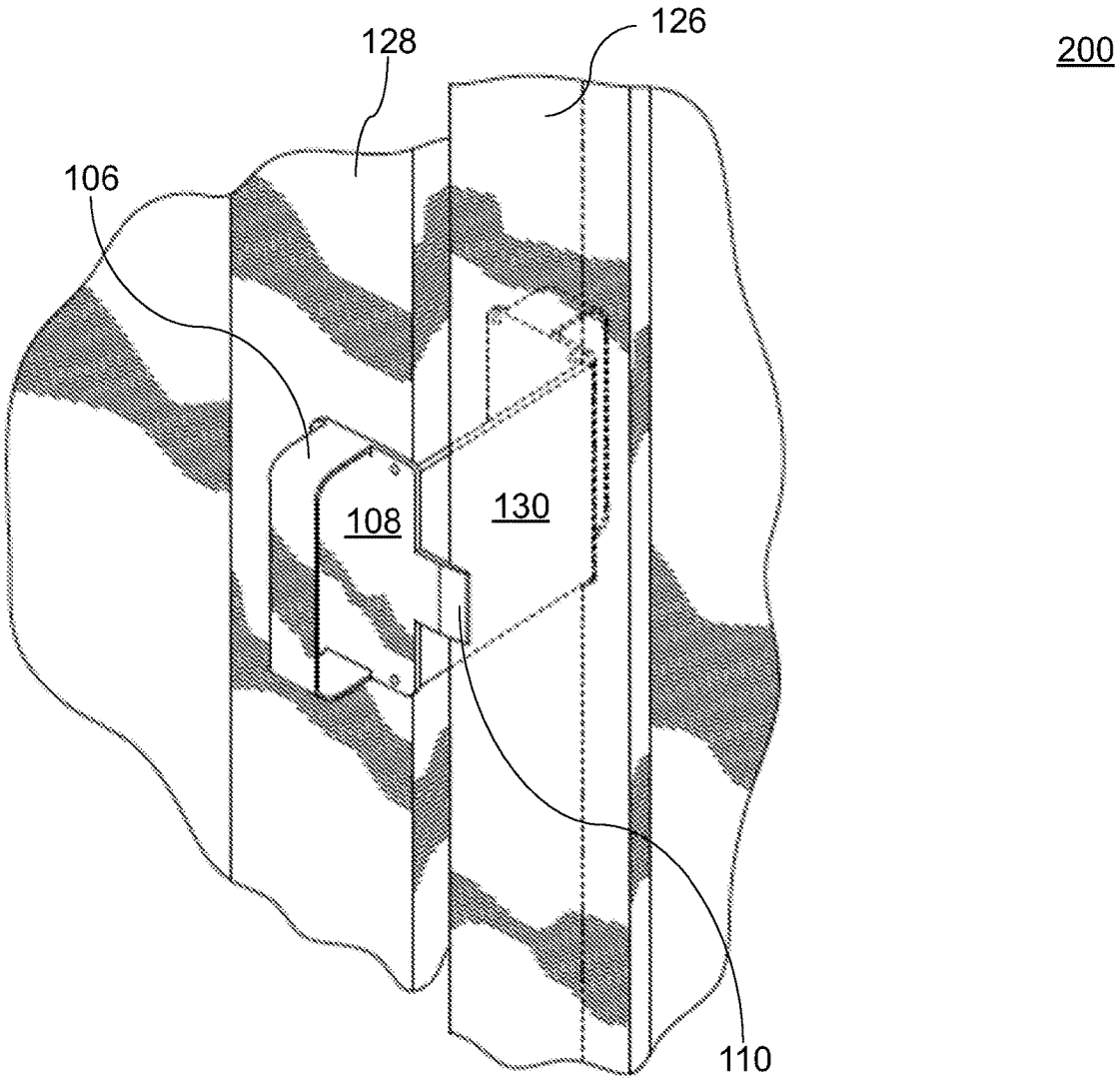
FIG. 8 depicts a perspective of a second embodiment of a double-sided gate handle device affixed to a gate, according to at least some embodiments disclosed herein.

A second embodiment of the present invention is depicted in at least FIG. 5, FIG. 6, FIG. 7, and FIG. 8. The second embodiment of the double-sided gate handle device 200 is substantially similar to the first embodiment of the double-sided gate handle device 100. For example, the second embodiment of the double-sided gate handle device 200 includes a first portion 104 and a second portion 108. However, the second embodiment of the double-sided gate handle device 200 includes a third portion 130 instead of the first adjustable component 112 and the second adjustable component 114 of the first embodiment of the double-sided gate handle device 100.

The second side of the first portion 104 of the second embodiment of the double-sided gate handle device 200 is separated by a distance 142 (of FIG. 5) from the second side of the second portion 108. Further, the second side of the first portion 104 is configured parallel to the second side of the second portion 108. The third portion 130 includes a body component and a first side disposed opposite a second side. The third portion 130 is disposed between the second side of the first portion 104 and the second side of the second portion 108 by the distance 142. Further, the third portion 130 is perpendicular to the second side of the first portion 104 and the second side of the second portion 108. As such, the first portion 104, the second portion 108, and the third portion 130 of the second embodiment of the double-sided gate handle device 200 form a U-shaped configuration.

In additional examples, the first embodiment of the double-sided gate handle device 100 and/or the second embodiment of the double-sided gate handle device 200 may comprise one or more light-emitting diodes (LEDs). In some examples, one or more of these LEDs may be solar-operated.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A double-sided gate handle comprising:

a first portion comprising:

a first plate having a first side disposed opposite a second side; and a first handle extending from the first side of the first plate;

a second portion comprising:

a second plate having a first side disposed opposite a second side;

a second handle extending from the first side of the second plate; and a stopper extending coplanar with the second plate, the stopper comprises a first side disposed opposite a second side, wherein the second side of the stopper is configured to contact a gatepost;

wherein the second side of the first plate is separated by a distance from the second side of the second plate, and wherein the second side of the first plate is parallel to the second side of the second plate; and a first adjustable component disposed between the second side of the first plate and the second side of the second plate by the distance, wherein the first adjustable component is perpendicular to the second side of the first plate and the second side of the second plate, the first adjustable component comprising:

a first protrusion extending from a peripheral edge of the second side of the first plate; and a second protrusion extending from a peripheral edge of the second side of the second plate;

wherein the second protrusion has an opening configured to slidably receive the first protrusion for adjusting the distance;

wherein a gate is configured to be received within the distance such that the second side of the first plate contacts a first portion of the gate, the second side of the second plate contacts a second portion of the gate, and a planar side of the second protrusion of the first adjustable component contacts a third portion of the gate.

2. The double-sided gate handle of claim 1, further comprising a second adjustable component disposed between the second side of the first plate and the second side of the second plate, wherein the second adjustable component is perpendicular to the second side of the first plate and the second side of the second plate.

3. The double-sided gate hinge of claim 2, wherein the second adjustable component comprises:

a third protrusion extending from a peripheral edge of the second side of the first plate; and a fourth protrusion extending from a peripheral edge of the second side of the second plate;

wherein the fourth protrusion has an opening configured to slidably receive the third protrusion for adjusting the distance.

4. The double-sided gate handle of claim 1, wherein the first protrusion and the third protrusion comprises a planar shape.

5. The double-sided gate handle of claim 3, wherein a width of the opening of each of the second protrusion and the fourth protrusion is larger than a width of the first protrusion and the third protrusion.

6. The double-sided gate handle of claim 1, wherein the first plate, the second plate, and the first adjustable component form a U-shaped configuration.

* * * * *